US011441834B2

(12) United States Patent
Marinello et al.

(10) Patent No.: US 11,441,834 B2
(45) Date of Patent: Sep. 13, 2022

(54) SKIN CONDENSER DESIGN INTEGRATED IN THE REFRIGERATOR BACK

(71) Applicant: WHIRLPOOL CORPORATION, Benton Harbor, MI (US)

(72) Inventors: Giulia Marinello, Park Ridge, IL (US); Sanjesh Kumar Pathak, Stevensville, MI (US); Gustavo Frattini, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 367 days.

(21) Appl. No.: 16/309,040

(22) PCT Filed: Oct. 26, 2016

(86) PCT No.: PCT/US2016/058817
§ 371 (c)(1),
(2) Date: Dec. 11, 2018

(87) PCT Pub. No.: WO2018/080473
PCT Pub. Date: May 3, 2018

(65) Prior Publication Data

US 2019/0178561 A1 Jun. 13, 2019

(51) Int. Cl.
*F25D 23/00* (2006.01)
*F25B 39/04* (2006.01)
(Continued)

(52) U.S. Cl.
CPC ..... *F25D 23/003* (2013.01); *F25B 39/04* (2013.01); *F25D 23/061* (2013.01);
(Continued)

(58) Field of Classification Search
CPC ... F25D 23/003; F25D 23/061; F25D 2201/14
See application file for complete search history.

(56) References Cited

U.S. PATENT DOCUMENTS 1,800,150 A * 4/1931 Musgrave ..... F25D 23/061 165/56
2,391,507 A * 12/1945 Philipp ..... F25B 39/04 62/453

(Continued)

FOREIGN PATENT DOCUMENTS

DE 19621054 A1 * 11/1997 ..... F25D 23/061
EP 1604159 A1 12/2005

(Continued)

*Primary Examiner* — Christopher R Zerphey
(74) *Attorney, Agent, or Firm* — Price Heneveld LLP

(57) ABSTRACT

A refrigerator includes a vacuum insulated cabinet structure having an exterior wrapper with a plurality of exterior walls exposed to ambient conditions. One of the exterior walls includes an outer surface and an inset portion that is inwardly disposed relative to the outer surface of the exterior wall. A skin condenser system is disposed within the inset portion along an outer surface of the inset portion. The skin condenser system includes a coil array defined by a coil disposed in a coil pattern. The skin condenser system further includes a cover assembly covering the coil array and in thermal communication with the coil array to facilitate the dissipation of heat to the ambient surroundings.

15 Claims, 4 Drawing Sheets

(51) Int. Cl.

| | |
|---|---|
| ***F25D 23/06*** | (2006.01) |
| ***F28D 1/047*** | (2006.01) |
| ***F28F 1/20*** | (2006.01) |
| ***F28D 1/02*** | (2006.01) |
| ***F28D 21/00*** | (2006.01) |

(52) U.S. Cl.
CPC ..... *F28D 1/0477* (2013.01); *F28F 1/20* (2013.01); *F25B 2339/045* (2013.01); *F25D 2201/14* (2013.01); *F28D 2001/0293* (2013.01); *F28D 2021/007* (2013.01)

(56) References Cited

U.S. PATENT DOCUMENTS

| | | | | | |
|---|---|---|---|---|---|
| 2,625,378 | A * | 1/1953 | Nason | F25D 23/061 | 165/171 |
| 2,703,702 | A | 3/1955 | Meinel | | |
| 2,961,851 | A * | 11/1960 | Ehrenfreund | F25D 23/061 | 62/448 |
| 4,024,620 | A * | 5/1977 | Torcomian | B23P 15/26 | 29/890.035 |
| 4,114,065 | A * | 9/1978 | Horvay | F25D 21/04 | 220/592.1 |
| 5,964,101 | A * | 10/1999 | Schulak | F24D 11/0214 | 62/430 |
| 6,955,064 | B2 * | 10/2005 | Lee | F25B 39/04 | 62/444 |
| 7,878,015 | B2 | 2/2011 | Lim et al. | | |
| 9,175,893 | B2 * | 11/2015 | Junge | F25D 17/065 | |
| 2005/0016203 | A1 * | 1/2005 | Espindola | F25D 23/061 | 62/453 |
| 2012/0023986 | A1 * | 2/2012 | Chae | F25D 21/04 | 62/132 |

FOREIGN PATENT DOCUMENTS

| | | | | |
|---|---|---|---|---|
| EP | 2789938 | A1 | 10/2014 | |
| JP | H1137632 | A | 2/1999 | |
| JP | 2011102599 | A | 5/2011 | |
| SU | 1661550 | A1 | 7/1991 | |
| WO | WO-03089859 | A1 * | 10/2003 | F25D 23/061 |
| WO | 2006037745 | A1 | 4/2006 | |
| WO | 2012152610 | A1 | 11/2012 | |

* cited by examiner

SKIN CONDENSER DESIGN INTEGRATED IN THE REFRIGERATOR BACK

BACKGROUND

The present concept generally relates to vacuum insulated structures, and more particularly, to a vacuum insulated structure having a skin condenser system disposed on an outer surface thereof to facilitate dissipation of heat produced from the vacuum insulated structure.

Generally, a natural convection condenser, such as a skin condenser, is typically located inside the insulation space of standard refrigerators. Such a design is not feasible when a refrigerator having a vacuum insulated structure is involved. A vacuum insulated structure presents a challenge to the flow of fumed silica within the vacuum cavity, and the ability of the vacuum insulated structure to hold a vacuum when accommodating outside heat exchange. Particularly, wire guides and access apertures are generally avoided in vacuum insulated structures in an effort to ensure that the vacuum insulated structure can hold a certain vacuum level so as not to compromise the insulating capabilities of the vacuum insulated structure. Thus, a solution for providing a skin condenser system in a refrigerator having a vacuum insulated structure is desired.

SUMMARY

One aspect of the present concept includes a refrigerator having an exterior wrapper with a plurality of exterior walls exposed to ambient conditions. One of the exterior walls includes an outer surface and an inset portion that is inwardly disposed relative to the outer surface of the exterior wall. A skin condenser system is disposed within the inset portion along an outer surface of the inset portion. The skin condenser system includes a coil array defined by a coil disposed in a coil pattern. The skin condenser system further includes a cover assembly covering the coil array and in thermal communication with the coil array.

Another aspect of the present concept includes a refrigerator having a vacuum insulated structure with a vacuum cavity disposed between a wrapper and one or more liners. The wrapper includes an exterior wall having an outer surface with an inset portion that includes an outer surface that is inwardly disposed relative to the outer surface of the exterior wall. A skin condenser system is received in the inset portion of the exterior wall and includes a coil array defined by a continuous coil configured in a coil pattern disposed in a single plane. The skin condenser system further includes a cover assembly covering the coil array and in thermal communication with the coil array.

Yet another aspect of the present concept includes a refrigerator having a vacuum insulated structure with a wrapper. The wrapper includes an exterior wall having an inset portion with an outer surface. A skin condenser system is received in the inset portion of the exterior wall and includes a coil array defined by a coil configured in a coil pattern. A cover assembly covers the coil array and includes a planar body portion and a raised channel system. The coil of the coil array is received in the raised channel system and is in thermal communication with the raised channel system.

These and other features, advantages, and objects of the present device will be further understood and appreciated by those skilled in the art upon studying the following specification, claims, and appended drawings.

DETAILED DESCRIPTION OF EMBODIMENTS

Figure 1:
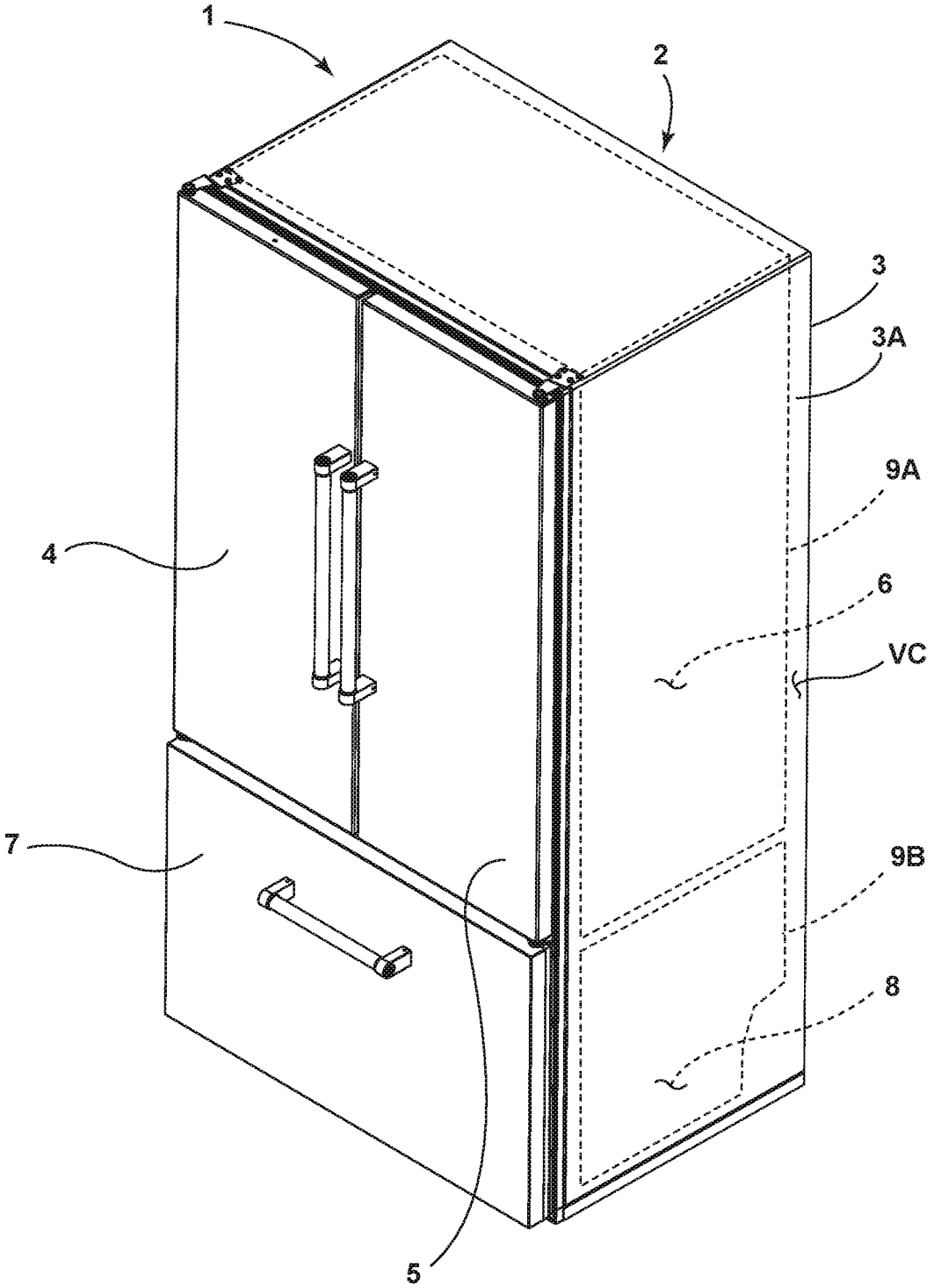
FIG. 1 is a front perspective view of a refrigerator including a vacuum insulated structure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, a refrigerator 1 includes a vacuum insulated cabinet structure 2 which includes an exterior wrapper 3 defining an outermost portion thereof. First and second doors 4, 5 are configured to selectively provide access to a refrigerator compartment 6. The refrigerator compartment 6 is generally defined by a refrigerator liner 9A. In the embodiment shown in FIG. 1, the refrigerator 1 further includes a drawer 7 which selectively provides access to a freezer compartment 8. The freezer compartment 8 is generally defined by a freezer liner 9B. The refrigerator liner 9A and freezer liner 9B are disposed within a cavity 3A defined by the exterior wrapper 3. A vacuum cavity VC is formed between the liners 9A, 9B and the exterior wrapper 3 from which a vacuum is drawn to provide the vacuum insulated cabinet structure 2. The configuration of the refrigerator 1 shown in FIG. 1 is exemplary only and the present concept is contemplated for use in all refrigerator styles, including, but not limited to, side-by-side refrigerators, whole refrigerator and freezers, and refrigerators with upper freezer compartments.

Figure 2:
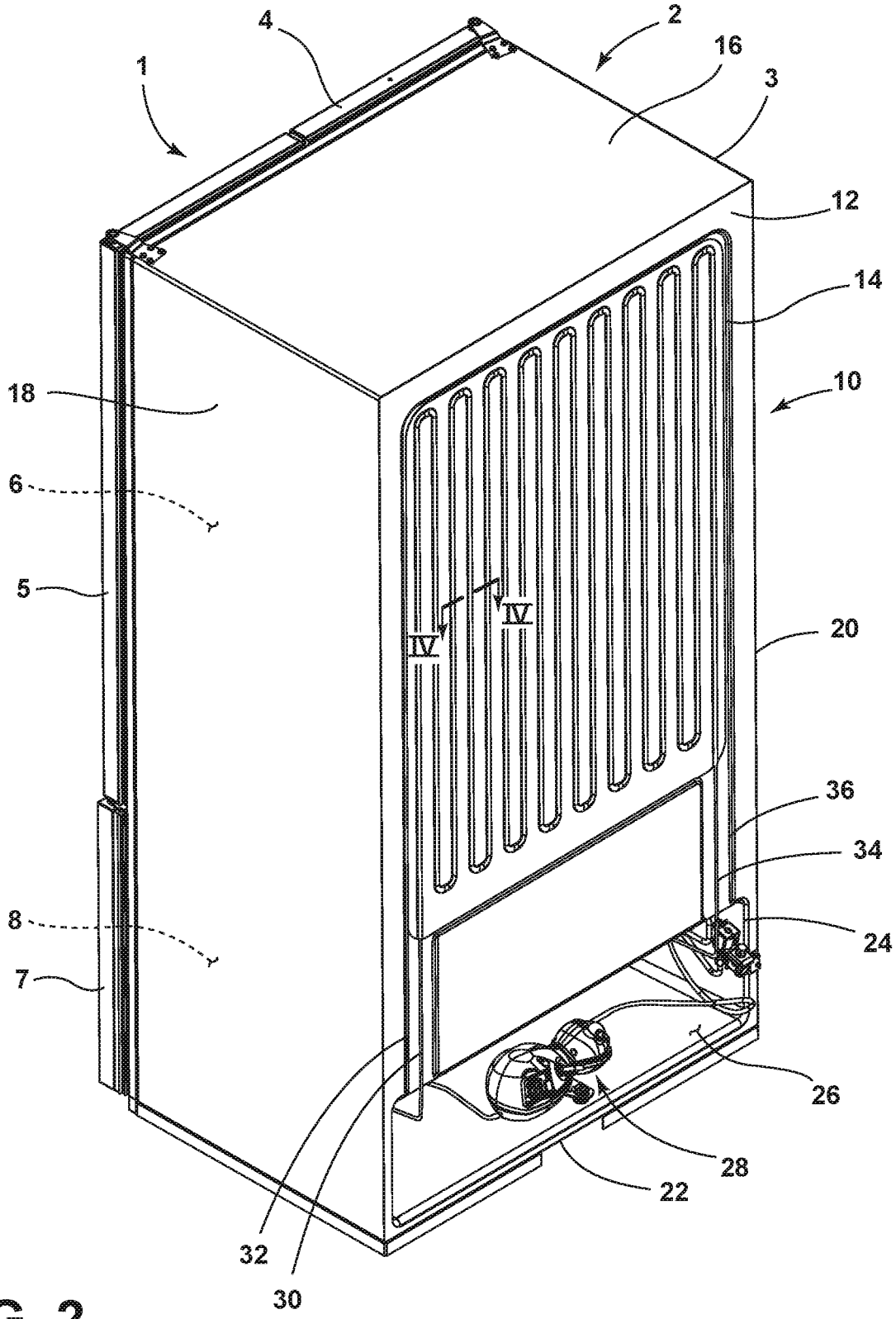
FIG. 2 is a rear perspective view of the refrigerator of FIG. 1 having an external skin condenser system.

Referring now to FIG. 2, the refrigerator 1 is shown from a rear perspective view, wherein a skin condenser system 10 is shown disposed on an exterior rear wall 12 of the exterior wrapper 3. Specifically, the skin condenser system 10 is shown disposed in an inset portion 14 of the rear wall 12 of the exterior wrapper 3. In the embodiment shown in FIG. 3, the exterior wrapper 3 includes a plurality of exterior walls including a top wall 16, first and second sidewalls 18, 20, a bottom wall 22, and rear wall 12. In this way, the exterior wrapper 3 defines the outer contours of the vacuum insulated structure 2. The rear wall 12, much like top wall 16, first and second sidewalls 18, 20 and bottom wall 22, is exposed to ambient conditions of the surrounding atmosphere. Specifically, the rear wall 12 includes an outer surface 12A which is exposed to the ambient temperatures of the surrounding atmosphere. The skin condenser system 10 is disposed in the inset portion 14 of the rear wall 12 which is inwardly displaced relative to the outer surface 12A of the rear wall 12. As positioned within the inset portion 14 of the rear wall 12, the skin condenser system 10 is exposed to the ambient conditions of the surrounding atmosphere, thereby allowing for temperature exchange by the skin condenser system 10 with the surrounding environment.

As further shown in FIG. 2, the rear wall 12 of the exterior wrapper 3 includes a relief portion 24 opening into and providing access to a machine compartment 26 in which cooling components are disposed for cooling the refrigerator compartment 6 and the freezer compartment 8 of the refrigerator 1. Specifically, the machine compartment 26 of the refrigerator 1 shown in FIG. 2 includes a compressor 28 which is fluidically coupled to the skin condenser system 10 to provide a high pressure, high temperature refrigerant in the form of a vapor to the skin condenser system 10 via inlet portion 30 which is disposed in an inset raceway 32 in the rear wall 12 of the exterior wrapper 3. The high pressure high temperature refrigerant vapor then moves through the skin condenser system 10 to an outlet portion 34 disposed in an inset raceway 36 of the rear wall 12 of the exterior wrapper 3. The refrigerant at the outlet 34 is generally considered to be a high pressure high temperature liquid which moves to an expansion device for delivery to an evaporator in the refrigerator compartment 6 and an evaporator in the freezer compartment 8. The refrigerant is moved as a low pressure low temperature liquid by the evaporators into the walls adjacent to the refrigerator compartment 6 and freezer compartment 8 for cooling the compartments 6, 8. As the refrigerant moves as a high pressure high temperature vapor through the skin condenser system 10, heat is exchanged with the outside ambient atmosphere to allow for heat dissipation of the heat produced during a refrigeration sequence. The first and second inset raceways 32, 36 interconnect the machine compartment 26 and the inset portion 14 of the rear wall 12 of the wrapper 3.

Figure 3:
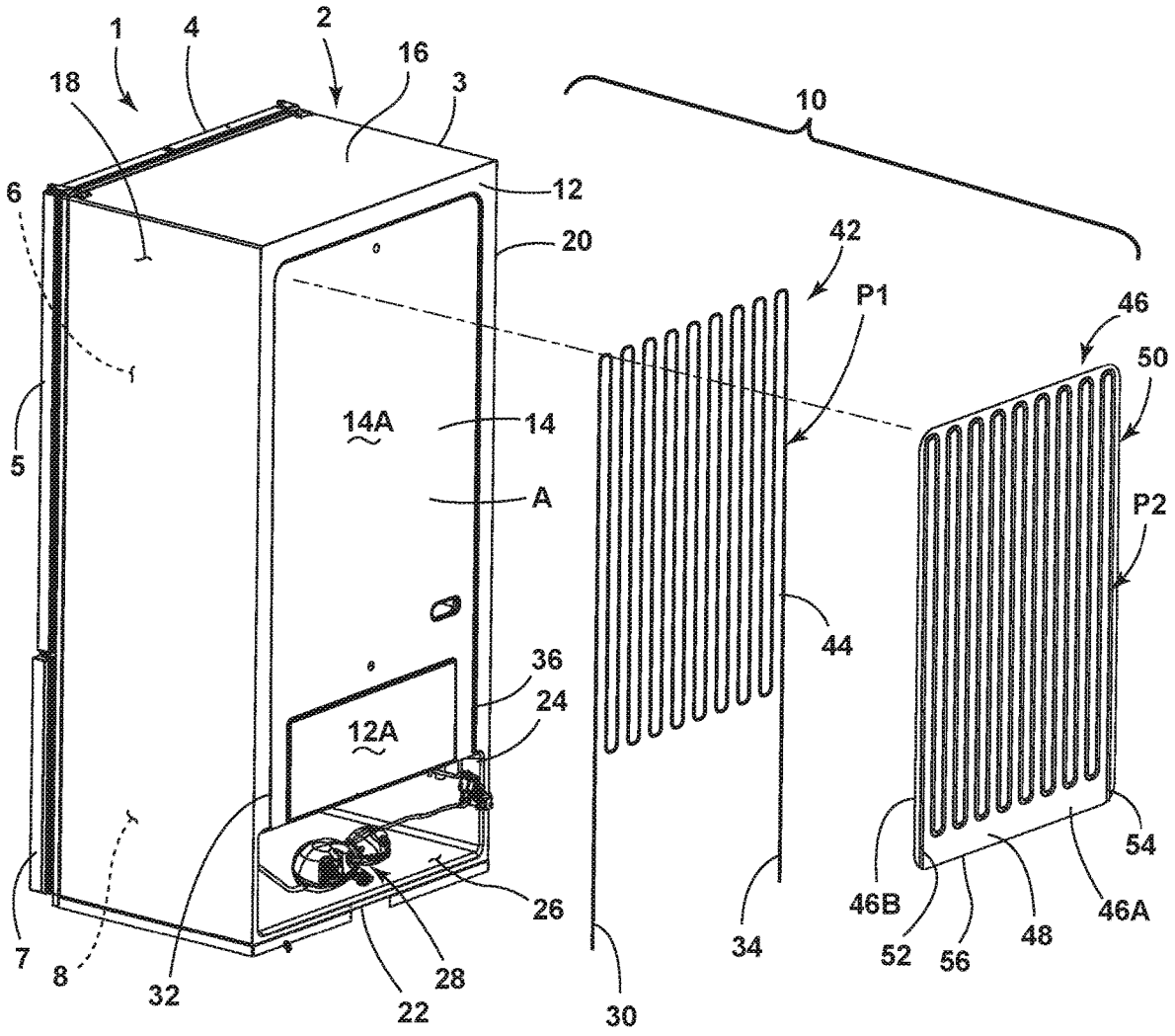
FIG. 3 is a rear perspective view of the refrigerator of FIG. 2 showing the skin condenser system exploded away therefrom.

Referring now to FIG. 3, the skin condenser system 10 is shown exploded away from the refrigerator 1, and specifically, exploded away from the inset portion 14 of the rear wall 12 of exterior wrapper 3. The skin condenser system 10 includes a coil array 42, wherein a continuous coil 44 extends from the inlet portion 30 through a vertically disposed serpentine coil array 42 and downward to the outlet portion 34. The coil 44 making up the coil array 42 is a continuous coil shown disposed in the vertical serpentine coil pattern P1 in FIG. 3, however, it is contemplated that the coil array 42 may be disposed in any pattern for accommodating the necessary heat exchange function of the skin condenser system 10. The coil pattern P1 of the coil 44 of the coil array 42 is configured in a single plane to substantially cover an exterior surface 14A of the inset portion 14 of rear wall 12 of the exterior wrapper 3. Thus, the inset portion 14 defines an area A which is substantially filled or covered by the coil array 42 via coil pattern P1 of the coil 44. By substantially covering the entire area A of the inset portion 14, the coil array 42 maximizes the ability to exchange heat with the ambient air conditions to which the rear wall 12 of the exterior wrapper 3 is exposed.

As further shown in FIG. 3, the skin condenser system 10 includes a cover assembly 46 having a generally planar body portion 48 and a raised or outwardly extending channel system 50 configured in a channel pattern P2 which correlates to the coil pattern P1 of the coil array 42. For purposes of this disclosure, the terms "correlates to", "correlated to", "correlating" refer to a pattern that substantially mirrors another. In the present case, the channel pattern P2 correlates to the coil pattern P1, such that the continuous channel of the channel pattern P2 follows the contours of the coil pattern P1 to cover the same. In this way, the channel system 50 is defined by a continuous channel disposed in a single plane that is configured to cover the coil array 42, while the planar body portion 48 of the cover assembly 46 is abuttingly supported on and coupled to the exterior surface 14A of the inset portion 14 of the rear wall 12 of the exterior wrapper 3. The cover assembly 46 is contemplated to be comprised of a metal material that provides a clean aesthetic for the rear portion of the refrigerator 1, as well as provides a thermal dissipation function. Specifically, the cover assembly 46, being comprised of a metal material, acts as a large fin that helps to dissipate heat coming from the coil array 42 of the skin condenser system 10. Thus, the cover assembly 46 is a highly conductive member which helps to dissipate heat into the surrounding atmosphere to which an outer surface 46A of the cover assembly 46 is exposed. An inner surface 46B of the cover assembly 46 is generally exposed to and in thermal communication with the coil 44 of the coil array 42 which is also contemplated to be comprised of a metal material. In this way, heat exchanged between the coil array 42 and the cover assembly 46 is readily conducted given the highly conductive materials that makeup the coil array 42 and cover assembly 46. Such materials may include sheet metal, copper, aluminum, and other like highly conductive metallic materials for providing the necessary heat exchange for the operation of the refrigerator 1.

As further shown in FIG. 3, the channel system 50 of the cover assembly 46 is a continuous channel system for accommodating the coil pattern P1 of the coil 44 of the coil array 42. The channel system 50 includes downwardly extending inlet and outlet receiving portions 52, 54 which generally comprise opposite ends of the continuous channel of the channel system 50. Between the inlet and outlet receiving portions 52, 54, the channel system 50 is configured in a vertically disposed serpentine channel pattern P2 that is raised outwardly from the planar body portion 48 of the cover assembly 46 to accommodate the vertically disposed serpentine coil pattern P1 of the coil 44 of coil array 42. As further shown in FIG. 3, the inlet and outlet receiving portions 52, 54 extend downward to a perimeter portion 56 disposed at a lower end of the planar body portion 48 which align with the inset raceways 32, 36 of the rear wall 12 of the exterior wrapper 3 in assembly, and are also configured to receive the inlet portion 30 and outlet portion 34 of the coil array 42 as shown in FIG. 2. The inset raceways 32, 36 interconnect the inset portion 14 of rear wall 12 with the machine compartment 26.

Figure 4:
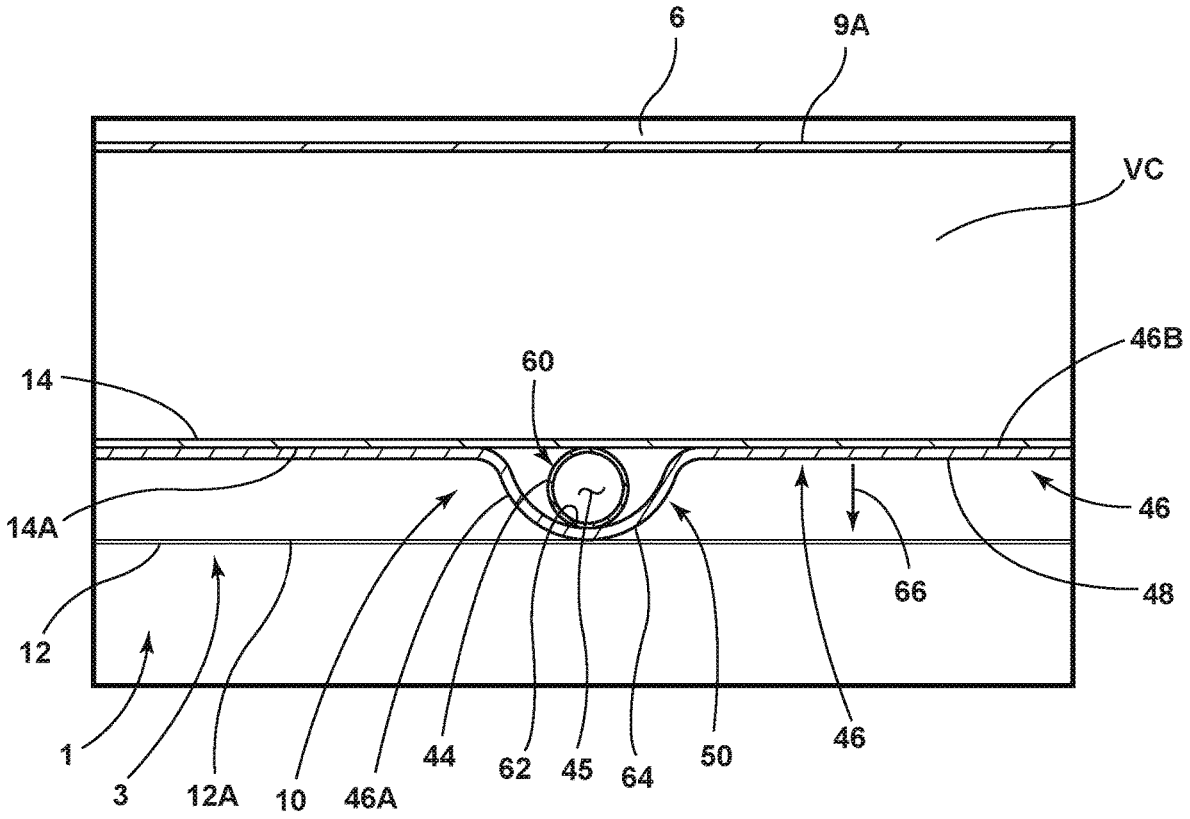
FIG. 4 is a cross-sectional view of the skin condenser system taken at line IV of FIG. 2.

Referring now to FIG. 4, a cross-sectional view of the skin condenser assembly 10 is shown. In the cross-sectional view, the wrapper 3 is shown spaced-apart from the refrigerator liner 9A to reveal a vacuum cavity VC disposed therebetween. The skin condenser system 10 is shown disposed externally relative to the exterior wrapper 3 on rear wall 12 thereof at inset portion 14. As specifically shown in FIG. 4, the coil 44 is shown disposed in contact with the outer surface 14A of the inset portion 14 of the rear wall 12 of the exterior wrapper 3 at an inner portion or first side 60 thereof. At an outer portion 62, or second opposite side, of the coil 44, the coil 44 is in contact with a channel 64 along inner surface 46B of the cover assembly 46. The channel 64 housing coil 44 is contemplated to be part of the continuous channel that outwardly extends in the direction as indicated by arrow 66 from the planar body portion 48 of the cover assembly 46. The channel 64 is part of the continuous channel that makes up the channel system 50 disposed in the channel pattern P2 as shown in FIGS. 2 and 3. The coil 44 is shown to be a hollow coil or tube having an interior cavity 45 which is used to move refrigerant in the form of a liquid or a gas that is generally of a high temperature, such that the contact between the coil 44 and the cover assembly 46 at portion 62 of the coil 44 provides for heat exchange with the ambient air to which the skin condenser system 10 is exposed. By positioning of the skin condenser system 10 on an exterior wall (rear wall 12) of the exterior wrapper 3, the skin condenser system 10 can help to dissipate heat from the coil array 42 (FIG. 3) through the cover assembly 46. Again, as noted above, the coil 44 of the coil array 42 is contemplated to be a metallic material that is highly conductive and in contact with the metal cover assembly 46 to efficiently dissipate heat produced during a refrigeration sequence into the ambient air by way of the cover assembly 46. As disposed within the inset portion 14 of the rear wall 12 of the exterior wrapper 3, the skin condenser system 10 does not increase the overall footprint of the refrigerator 1. With specific reference to the cross-sectional view shown in FIG. 4, the channel 64 is shown as extending up to, but not beyond, the exterior surface 12A of the rear wall 12 of the exterior wrapper 3. In this way, the outer surface 46B of the cover assembly 46 of the skin condenser system 10 does not extend outwardly beyond the exterior surface 12A of the exterior wrapper 3 and is sheltered within the inset portion 14 of the rear wall 12.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:

an exterior wrapper having a plurality of exterior walls exposed to ambient conditions, wherein one of the exterior walls includes an outer surface and an inset portion that is inwardly disposed relative to the outer surface of the exterior wall; and a skin condenser system disposed within the inset portion along an outer surface thereof, the skin condenser system comprising:

a coil array defined by a continuous coil disposed in a coil pattern; and a cover assembly covering the coil array and in thermal communication with the coil array, wherein the cover assembly includes a planar body portion directly coupled to the outer surface of the inset portion, and further wherein the cover assembly includes a channel system extending rearwardly from the planar body portion of the cover assembly, wherein the channel system includes a continuous channel configured in a channel pattern that correlates to the coil pattern of the coil array, such that the continuous coil of the coil array is received within the continuous channel of the channel system.

2. The refrigerator of claim 1, wherein the continuous coil of the coil array is in contact with the outer surface of the inset portion on a first side thereof and further in contact with an inner surface of the cover assembly on a second opposite side thereof.

3. The refrigerator of claim 1, wherein the channel system of the cover assembly does not extend beyond a plane defined by the outer surface of the exterior wall of the exterior wrapper.

4. The refrigerator of claim 3, wherein the cover assembly and the coil array are comprised of metal materials.

5. A refrigerator, comprising:

a vacuum insulated structure having a vacuum cavity disposed between a wrapper and one or more liners, wherein the wrapper includes an exterior wall having an outer surface with an inset portion that includes an outer surface that is inwardly disposed relative to the outer surface of the exterior wall; and a skin condenser system received in the inset portion of the exterior wall, the skin condenser system comprising:

a coil array defined by a continuous coil configured in a coil pattern disposed in a single plane; and a cover assembly covering the coil array and in thermal communication with the coil array, wherein the cover assembly includes a planar body and a channel system extending rearwardly from the planar body portion of the cover assembly, wherein the channel system includes a continuous channel configured in a channel pattern that correlates to the coil pattern of the coil array, such that the continuous coil of the coil array is received within the continuous channel of the channel system.

6. The refrigerator of claim 5, wherein the planar body portion of the cover assembly is directly coupled to the outer surface of the inset portion.

7. The refrigerator of claim 5, wherein an outer surface of the cover assembly is disposed inwardly of the outer surface of the exterior wall of the wrapper.

8. The refrigerator of claim 5, wherein the vacuum insulated structure includes a relief portion opening into a machine compartment.

9. The refrigerator of claim 8, wherein the machine compartment includes a compressor fluidically coupled to the skin condenser system at an inlet portion of the coil array.

10. The refrigerator of claim 9, wherein the inlet portion of the coil array is received in a first inset raceway, the first inset raceway interconnecting the machine compartment to the inset portion of the exterior wall.

11. The refrigerator of claim 10, wherein the coil array includes an outlet portion received in a second inset raceway, the second inset raceway interconnecting the machine compartment to the inset portion of the exterior wall.

12. A refrigerator, comprising:

a vacuum insulated structure having a wrapper, wherein the wrapper includes an exterior wall having an inset portion with an outer surface; and a skin condenser system received in the inset portion of the exterior wall, the skin condenser system comprising:

a coil array defined by a continuous coil configured in a coil pattern; and a cover assembly covering the coil array, the cover assembly including a planar body portion and rearwardly extending channel system, wherein the channel system includes a continuous channel configured in a channel pattern that correlates to the coil pattern of the coil array, such that the continuous coil of the coil array is received within the continuous channel of the channel system and in thermal communication therewith.

13. The refrigerator of claim 12, wherein the outer surface of the inset portion of the exterior wall defines an area, and further wherein the coil pattern substantially covers the area.

14. The refrigerator of claim 13, wherein the area is substantially covered by the cover assembly.

15. The refrigerator of claim 12, wherein the rearwardly extending channel system does not extend beyond an outer surface of the exterior wall.

* * * * *